US010465500B2

(12) United States Patent
Robertson et al.

(10) Patent No.: US 10,465,500 B2
(45) **Date of Patent: *Nov. 5, 2019**

(54) PERMANENT OR REMOVABLE POSITIONING APPARATUS AND METHOD FOR DOWNHOLE TOOL OPERATIONS

(71) Applicant: Robertson Intellectual Properties, LLC, Mansfield, TX (US)

(72) Inventors: Michael C. Robertson, Arlington, TX (US); William F. Boelte, New Iberia, LA (US); Douglas J. Streibich, Fort Worth, TX (US)

(73) Assignee: Robertson Intellectual Properties, LLC, Mansfield, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/864,960

(22) Filed: Jan. 8, 2018

(65) Prior Publication Data

US 2018/0195379 A1 Jul. 12, 2018

Related U.S. Application Data

(63) Continuation of application No. 13/507,732, filed on Jul. 24, 2012, now Pat. No. 9,863,235.

(60) Provisional application No. 61/572,920, filed on Jul. 25, 2011.

(51) Int. Cl.

| | |
|---|---|
| ***E21B 47/09*** | (2012.01) |
| ***E21B 47/01*** | (2012.01) |
| ***E21B 47/024*** | (2006.01) |

(52) U.S. Cl.
CPC ..... *E21B 47/09* (2013.01); *E21B 47/01* (2013.01); *E21B 47/024* (2013.01)

(58) Field of Classification Search
CPC combination set(s) only.
See application file for complete search history.

(56) References Cited

U.S. PATENT DOCUMENTS 2,862,564 A * 12/1958 Bostock ..... E21B 23/02 166/125
4,295,750 A * 10/1981 F'Geppert ..... F16D 1/06 403/251
6,012,527 A * 1/2000 Nitis ..... E21B 7/061 166/313

(Continued)

*Primary Examiner* — David J Bagnell
*Assistant Examiner* — Ronald R Runyan

(57) ABSTRACT

A system and method for positioning a tool within a wellbore, wherein the interior surface of a positioning apparatus includes one or more pluralities of grooves, each defining a selected profile. A tool is lowered into the positioning apparatus, having a blade in communication therewith. The blade includes a plurality of protruding members, which define a profile complementary to at least one of the selected profiles formed by one of the pluralities of positioning apparatus grooves. A biasing member in communication with the blade can continually bias the blade toward the interior surface of the positioning apparatus to cause the profile of the blade to engage within the corresponding complementary profile of the positioning apparatus. Positioning a tool in this manner is advantageous for locating cutting tools at a precise location to sever a joint, perforate casing or stack multiple tool operations at a fixed, targeted point within a wellbore.

17 Claims, 3 Drawing Sheets

(56) References Cited

U.S. PATENT DOCUMENTS

| | | | | |
|---|---|---|---|---|
| 8,616,293 | B2 * | 12/2013 | Robertson | E21B 23/02 166/382 |
| 9,863,235 | B2 * | 1/2018 | Robertson | E21B 47/01 |
| 2003/0188876 | A1 * | 10/2003 | Vick | E21B 33/1208 166/382 |

* cited by examiner

PERMANENT OR REMOVABLE POSITIONING APPARATUS AND METHOD FOR DOWNHOLE TOOL OPERATIONS

CROSS-REFERENCE TO RELATED APPLICATIONS

This application is a continuation application, which claims the benefit of, and priority to, U.S. application Ser. No. 13/507,732, filed on Jul. 24, 2012, which claims the benefit of U.S. Provisional Patent Application Ser. No. 61/572,920, filed on Jul. 25, 2011. The contents of the prior applications are hereby incorporated by reference herein in their entireties.

FIELD

The present invention relates, generally, to systems and methods usable for fixating and orienting toolstrings within a wellbore. The present invention further relates to downhole wellbore positioning apparatus and methods whose deployment is a secondary process to an initial construction feature further able to function with or without up-hole operator control.

BACKGROUND

A need exists, in the oil and gas industry, for the ability to anchor, clock in direction, and eventually release a transient toolstring that will allow for precise and effective tool system performance. Enabling the precise location of a force, torque, sensor, perforation, drilling exit or other application, at an optimal position, further reduces the requirement to reposition multiple-run, single location tool processes while reducing the chances of misguided or off-position deployments.

During conventional well construction and other downhole operations, components utilized in such processes often become stuck. Conventionally, when this occurs, the stuck component must be freed or removed to resume well operations. In other instances, a downhole component that has reached its design life limits must be removed from service. Conventional apparatus and methods provide limited choices of techniques useful to wholly or partially free or remove such equipment, many of which involve cutting or otherwise perforating a component to remove at least a portion of the string and/or any attached tools from the wellbore.

Some existing tool systems, deployed within a wellbore, are constructed with control lines surrounding the periphery of a pipe. Removal of the pipe requires cutting both the target pipe and the control line(s) for further completion operations to occur. Having the ability to make precise, multiple cuts at a single target plane can enable both elements to be cut; however, such operations are restricted to cutting without causing harm to the backside infrastructure. Thus, placing tools that enable precise energy delivery for cut effectiveness is preferred.

Drilling equipment requires use of heavy-walled tubular members, having small inner diameters, which limits the amount of working space within a tubular string. Therefore, when cutting or otherwise attempting to remove these heavy-walled tubular components, the effectiveness of conventional cutting and removal tools is limited due to the small size of such components necessary for insertion into the tubular string. When stacking multiple cutting or perforating events on the exact location of previous useful work, additive or compounding benefits are realized.

Tubular strings include numerous joints, used to connect lengths of drill pipe, drill collars, bits, steering devices, sensors, mandrels, and other tools and tubular components. To maximize the effectiveness of a cutting device, it is desirable to position a tool directly over a joint between tubular segments. Joints within a drill string typically include male (pin thread) and female (box thread) ends, resulting in a thinner section profile at the cut location. When cutting a tubular string where a torqued joint is present, those torque forces are released. The reduction in tensile force at the joint allows the tubular segments to be readily pulled apart, enabling retrieval of the upper portion of the tubular string.

When screwed together and properly torqued, joints within a tubular string become relatively seamless, thus difficult to locate using conventional well logging devices. While casing collar locators and similar devices are usable to assist in positioning a tool within a tubular string, existing devices are limited in their accuracy, and are generally accurate to within a number of feet. A joint target within a tubular string may be inches in length, requiring far more precise placement of a tool than what is conventionally available using collar locators and similar devices.

Completion processes taking place within a wellbore often require placing sensors, perforating a wall for communication, and perforating a casing such that contact with a geological feature is made. Operations, such as gauge integration, cement squeezing, fracturing and jet drilling, become subsequent processes.

Other positioning systems can include providing physical features within the interior of a tubular string that interact with corresponding physical features of a locating tool; however, these positioning systems require numerous precisely crafted features to ensure proper function and interaction, including various moving parts to cause selective engagement between corresponding features.

A need exists for removable positioning apparatus and methods for positioning a tool with complementary mating integration capacity within a tubular string, for enabling precise positioning of anchorable tools at a preselected location, including joints within the tubular string, to facilitate the effectiveness of tools. Having the flexibility of a selectively placed locking feature within a tubular member greatly reduces the size of the apparatus necessary to positively fixate a tool using pre-positioned anchoring profile mechanisms within a wellbore system.

A further need exists for positioning apparatus and methods usable for positioning a tool within a tubular string that are simple in construction and function, able to incorporate reusable, machinable, and re-machinable parts, and able to accommodate a variety of latching and/or engaging orientations.

A need also exists for positioning apparatus and methods usable for positioning a tool within a tubular string that are conveyable and deployable utilizing readily available setting tools.

The present embodiments meet these needs.

SUMMARY

The present invention relates, generally, to a system usable to position a tool deployed with anchoring-capable features within a wellbore.

Embodiments of the invention can include a mechanism which when activated, securely affixes the anchor to the wellbore inside diameter or wall feature with mechanical, magnetic, or chemical means. In one such embodiment of the invention, the use of slip and cone compression fixation, widely used for plugging operations, is adequate for permanent and temporary anchoring.

A section of the interior of the permanent or removable anchor is provided with a plurality of grooves and/or a slotting or other means of selective clocking/orienting/azimuthal direction.

Grooves define a selected profile, which can engage a complementary profile that can be disposed in association with the tool to be positioned. The selected profile can be defined by the spacing between the grooves, the depth of the grooves, the interior shape of the grooves, or other similar features usable to differentiate the selected profile from other features or profiles within the tubular string. In an embodiment of the invention, the selected profile can be shaped to permit downward movement of a complementary profile into engagement, while preventing upward movement, such as through use of an upwardly facing no-go shoulder, or a similar element within the selected profile and/or the complementary profile, In another embodiment, a size of the spacing between the grooves varies around the inner diameter of the anchor.

In a further embodiment of the invention, the mechanism or keyset for clocking is variable for the degree in which a setting position is defined.

In a further embodiment of the invention, the components, for which anchoring to the target internal diameter are made, are retractable, displaceable or removable with an application of force from jarring, hammering, stroking, dissolving, cutting, or other similar methods. When a structural member of the anchor system is physically severed or impaired, the structural integrity of the anchor can be lost, rendering it impermanent.

When a function specific tool is lowered into or past the prior set positioning apparatus bore, a blade or a plurality of blades can be provided in communication with the entering toolstring, and the blade can have a plurality of protruding members extending therefrom. The protruding members define a male or female profile complementary to the selected male or female profile within the positioning apparatus located inside the bore, such that when the tool is lowered, the blade can contact the selected profile, and the complementary profile can engage and lock within the selected profile, allowing the precise position of the tool, in relation to the grooves within the tubular string, to be determined. When profiles integrating a clocking profile for directional placement are present, the position result is defined by that direction, as placed and locked during anchor deployment.

While the present invention is usable to position any tool within a tubular string, in a preferred embodiment of the invention, the tool can include a torch, a cutter, or another type of cutting and/or perforating device intended to at least partially cut into a portion of the tubular string. The selected profile, within the anchor, can be disposed proximate to a joint within the string, such that when the complementary profile of the blade is engaged with the selected profile, the tool can be oriented to cut or perforate the tubular string at or proximate to the joint. Cutting and/or perforating a tubular at or proximate to a joint can release tensile forces from the torqued joint, facilitating removal of a severed portion of the tubing string from the wellbore.

In use, a positioning apparatus can be provided with any number of selected profiles, which differ from one another. Prior to lowering a tool into the positioning apparatus, the tool can be provided with a profile complementary to any of the selected profiles within the positioning apparatus that corresponds to the location to which it is deployed. After the tool has been actuated, or once it is no longer desirable to retain the tool in engagement with the selected profile, the tool can be removed, such as by shearing a shear pin or other frangible member, enabling removal of the tool.

The present invention thereby provides positioning apparatus and methods able to very accurately position a tool within a tubular string containing the apparatus at one or more deployed locations, with greater precision than existing methods. Further, the present positioning apparatus and methods can include directionally biased members that can be usable to selectively engage and disengage from selected locations within an anchor. An additional feature of the positioning apparatus is the unobstructed bore, which can allow toolstrings to pass through the positioning apparatus in order to conduct operations below selected systems.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

Figure 1A:
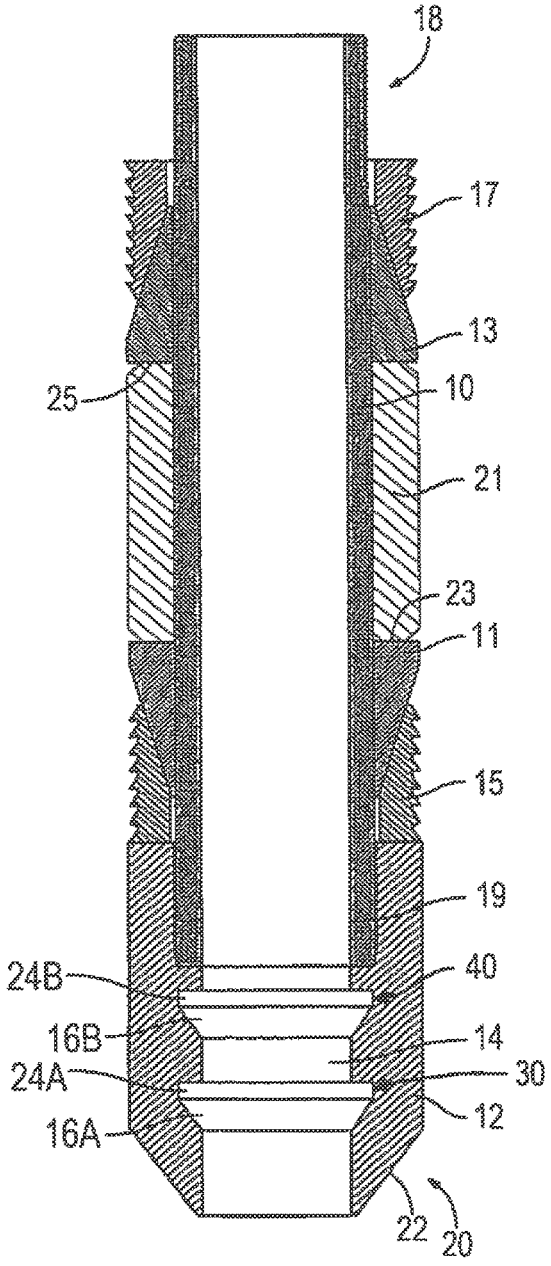
FIGS. 1A-1C depict cross-sectional side views of embodiments of a positioning apparatus usable within the scope of the present disclosure.
Figure 1B:
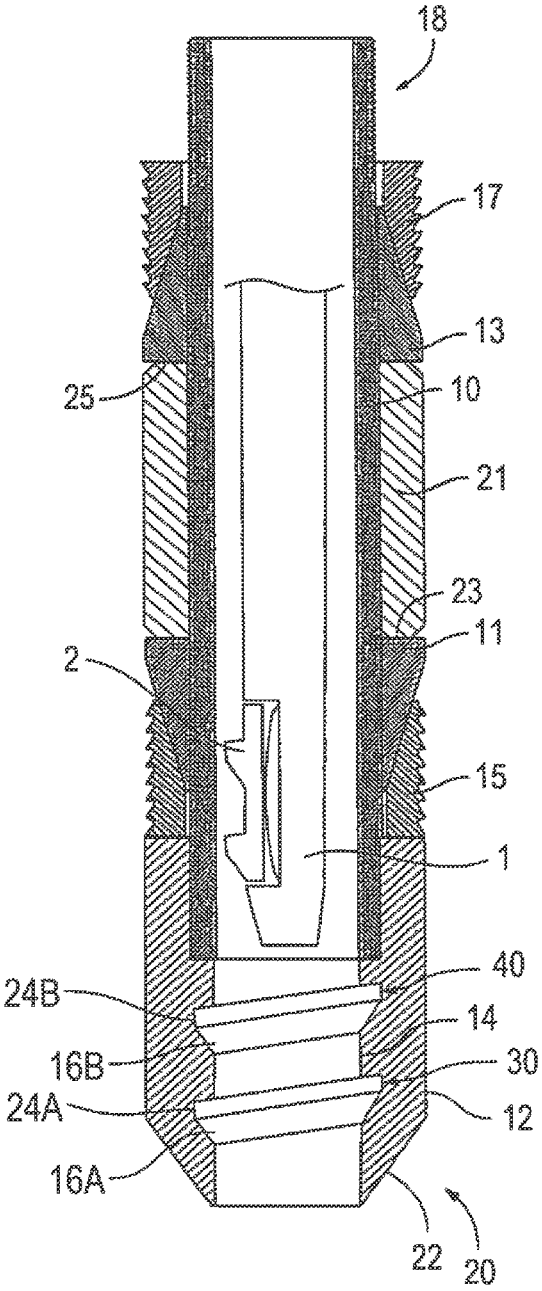
Figure 1C:
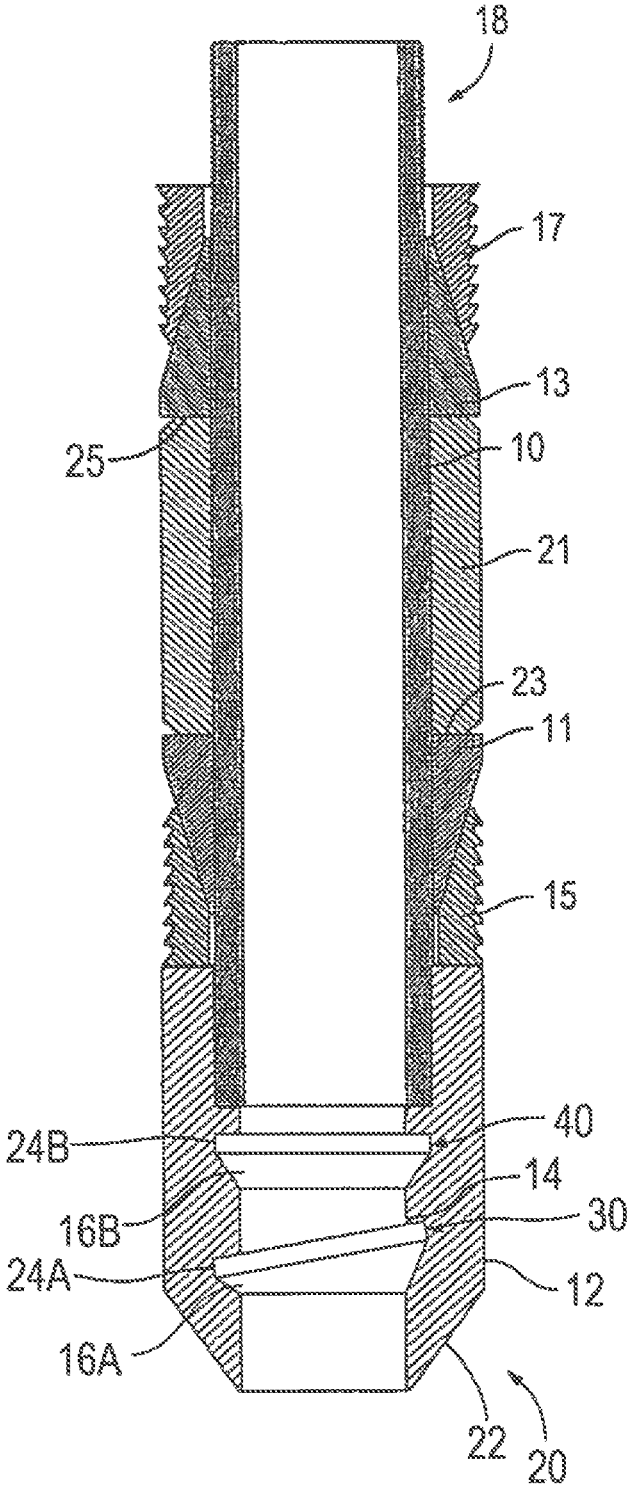
Figure 2:
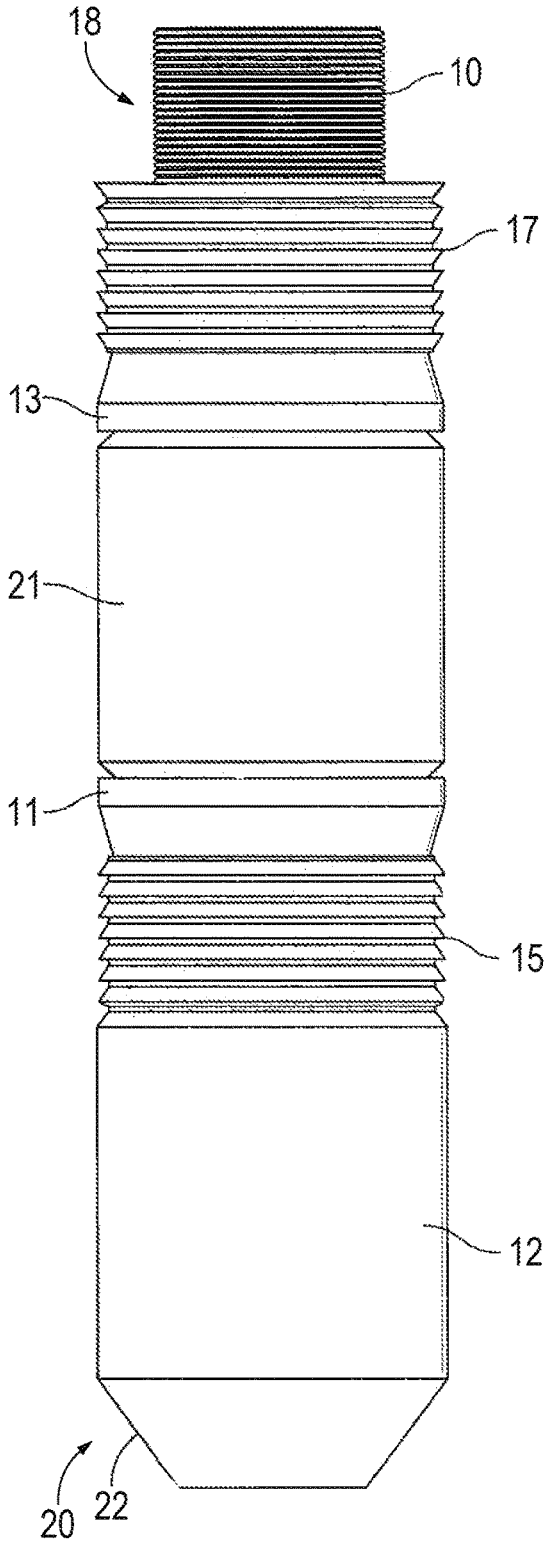
FIG. 2 depicts a cross-sectional side view of the positioning apparatus of FIGS. 1A-1C.

The present invention relates, generally, to a system usable to position a tool deployed with anchoring-capable features within a wellbore. Embodiments of the present positioning apparatus can include members for mechanical fixation to a structural member. When utilizing mechanical fixation, as shown in FIGS. 1A-1C and 2, a wedging action resulting from a tensile or compressive force application to a slip and cone assembly can be used. As a load is applied, typically with an oilfield setting tool, the slips can be forced over a cone section, creating high compressive loading and friction between the slips and the target pipe inside diameter.

FIGS. 1A-1C and 2 depict an embodiment of a positioning apparatus that includes an anchor assembly (12) (i.e., permanent or removable anchor assembly) that is coupled to a structural mandrel (10). In the illustrated embodiment, the anchor assembly (12) (i.e., permanent or removable anchor assembly) is coupled to the mandrel (10) via a threaded connection (19). The anchor assembly (12) (i.e., permanent or removable anchor assembly) contains an internal profile (14) with a groove or a plurality of grooves (16A, 16B) and/or a slot in which a complementary projected profile, plurality of projected profiles, and/or a slot acquiring member of a tool or similar component may reside. While FIGS. 1A-1C and 2 depict grooves (16A, 16B) for mechanical engagement with complementary protrusions of an apparatus and/or tubular string, it should be understood that in various embodiments, the grooves (16A, 16B), and/or the complementary protrusions for engagement therewith, can include one or more magnets (30) for providing magnetic adhesion, and/or one or more chemicals (40) (e.g., adhesives, epoxies, or similar substances) to provide a chemical adhesion. In a magnetically fixed condition, a high strength magnet can be slid into a position such that close contact results in high magnetic affinity and subsequent fixation. Chemical fixation can take the form of a firm or semi-firm glue action, a secreted fast setting polymer, or an epoxy compatible with the wellbore fluid. In further embodiments, chemical and/or magnetic adhesion can be used in place of any mechanical engagement, and use of grooves (16A, 16B) can be omitted.

In the depicted embodiment, the mandrel (10) is shown having first and second cone and/or wedge-shaped protrusions (11, 13), which can provide engagement between the slips (15, 17) and the interior surface of a wellbore conduit. A sealing section (21), which is shown disposed between the cone and/or wedge shaped protrusions (11, 13), both of which are further shown having generally perpendicular shoulders (23, 25), expands to create a sealing contact between the sealing section (21) and the interior surface of the wellbore conduit.

A portion of the positioning apparatus, usable to position a tool (1) having a discrete complementary profile (2) disposed thereon, is designed. The apparatus tubular segment, having a first end (18) and a second end (20) (e.g., a top and/or uphole end and a bottom and/or downhole end, respectively), can include a chamfer (22) for the complementary toolstring to align and penetrate into or through the positioning apparatus.

The interior surface of the positioning apparatus thus defines a selected female profile (14), which can be usable to engage with a complementary male profile disposed in association with a tool. In an embodiment, a profile having no-go shoulders (24A, 24B) within, which prevent upward movement of an engaged tool when a complementary profile having similar shoulders is locked within the grooves, can be used.

The arrangement of grooves can define and/or include multiple profiles for enabling the anchor or similar apparatus to be installed in an inverted orientation, or to pass through the apparatus for positioning elsewhere, when it is desirable to enable engagement with certain selected male profiles. A complementary male profile configured to engage with a selected female profile will pass over a non-matching and/or inverted female profile.

When a torch or similar apparatus, with a latching anchor toolstring, is lowered to the selected position within the wellbore-set positioning apparatus, the protrusions of the profile matching latch of the torch and/or anchor become engaged within the positioning apparatus grooves (16A, 16B).

Once operations concerning the deployed toolstring are completed, the toolstring can be removed from the positioning apparatus by shearing a pin, overcoming a locking spring force, or other release techniques known in the art, thereby removing the protrusions from the grooves (16A, 16B).

Additionally, once positioning apparatus are completed following toolstring removal, the mechanical, magnetic, and/or chemical fixation method can be reversed, utilizing means common to those fixation techniques as taught in prior known art procedures.

In an embodiment of the present invention, the positioning apparatus can include the ability and can be usable for, or include the method of, initially, or subsequent to prior operations, setting an effective apparatus within the inside diameter of the mandrel. Such additional components can be a smaller diameter plug for sealing (thus conveying an effective smaller plug in likely restricted access channels), installing sensor gauges for well monitoring, inserting valve components for flow control, inserting a flapper valve arrangement or other oil well control improvements requiring anchoring, clocking and an advantage of reduced diameter passage. All systems can remain permanent or retrievable as designed or as taught conventionally.

While various embodiments of the present invention have been described with emphasis, it should be understood that within the scope of the appended claims, the present invention might be practiced other than as specifically described herein.

The invention claimed is:

1. A tool positioning apparatus for positioning a downhole tool within a wellbore, comprising:

an anchor assembly inserted within an interior surface of the wellbore and comprising an inner diameter having a selected profile comprising a plurality of grooves formed therein for selective engagement with a discrete complementary profile of the downhole tool, wherein the discrete complementary profile comprises one or more protruding members for selective engagement with the selected profile when the downhole tool is inserted into the anchor assembly, wherein each of the grooves of the plurality of grooves comprises a no-go shoulder configured to prevent movement of the downhole tool in one direction and permit movement of the downhole tool in a second direction, wherein the selected profile comprises a biased member configured to clock the complementary profile in a selective azimuthal direction and position, wherein the selected profile comprises a space between two of the plurality of grooves, and a size of the space varies around the inner diameter of the anchor assembly;

one or more slips configured to engage the interior surface of the wellbore or a conduit after completion processes have taken place within the wellbore; and a mandrel engaged with the anchor assembly, wherein the mandrel comprises a plurality of cones extending therefrom, wherein the plurality of cones comprises a first cone facing a first end of the tool positioning apparatus and a second cone facing a second end of the tool positioning apparatus to force the one or more slips against the interior surface in response to a compression force, and wherein the tool positioning apparatus is removable from the interior surface of the wellbore or the conduit.

2. The apparatus of claim 1, further comprising a sealing member disposed about the mandrel between the first cone and the second cone.

3. The apparatus of claim 1, wherein the mandrel is further engaged with the anchor assembly using a threaded engagement.

4. The apparatus of claim 1, wherein the mandrel, the anchor assembly, or combinations thereof, further comprise at least one magnetic member, and wherein said at least one magnetic member further secures the tool to the anchor assembly.

5. The apparatus of claim 1, wherein the mandrel, the anchor assembly, or combinations thereof, further comprise at least one chemical element for providing chemical fixation between the tool and the anchor assembly.

6. The apparatus of claim 1, wherein the anchor assembly further comprises a chamfered end for facilitating alignment and penetration of an object through the tool positioning apparatus.

7. The apparatus of claim 1, wherein at least one of the no-go shoulders of the plurality of grooves prevents upward movement of the tool and permits downward movement of the tool.

8. The apparatus of claim 1, wherein the plurality of grooves comprises multiple female profiles, and wherein each female profile is adapted for engagement with a discrete corresponding male profile.

9. The apparatus of claim 1, wherein the selected profile and the discrete complementary profile comprise a selected depth of the grooves in the plurality of grooves, a selected interior shape of the grooves in the plurality of grooves, or combinations thereof, to differentiate the discrete complementary profile from a different complementary profile.

10. The apparatus of claim 1, wherein the downhole tool functions after completion processes to perform: jet drilling, fracturing, cement squeezing, gauge integration, or combinations thereof.

11. A method for positioning a tool positioning apparatus, comprising the steps of:

lowering the tool positioning apparatus within an interior surface of a wellbore or a conduit after completion processes have taken place within the wellbore, wherein the tool positioning apparatus comprises an anchor assembly and a mandrel having a plurality of cones extending therefrom, wherein the plurality of cones comprises a first cone and a second cone, wherein the anchor assembly further comprises an inner diameter having a selected profile comprising a plurality of grooves formed therein for selective engagement with a discrete complementary profile comprising one or more protruding members of a tool, wherein each of the grooves in the plurality of grooves comprises a no-go shoulder configured to prevent movement of the tool in one direction and permit movement of the tool in a second direction;

compressing one or more slips with the plurality of cones to cause the one or more slips to engage the interior surface of the wellbore or the conduit;

lowering the tool into the tool positioning apparatus and clocking the tool into a selective azimuthal direction and position using a biased member of the anchor assembly for selective engagement of the discrete complementary profile of the tool with the selected profile of the anchor assembly, wherein the selected profile comprises a space between two of the plurality of grooves, and a size of the space varies around the inner diameter of the anchor assembly; and removing the tool positioning apparatus from the interior surface of the wellbore or the conduit.

12. The method of claim 11, wherein the step of providing the tool positioning apparatus into association with the tool comprises engaging the plurality of grooves of the selected profile formed on the inner diameter of the anchor assembly with the protruding members of the discrete complementary profile of the tool.

13. The method of claim 11, further comprising the step of threadably engaging the mandrel with the anchor assembly.

14. The method of claim 11, wherein said inner diameter of the anchor assembly, an inner diameter of the mandrel, or combinations thereof, comprises a plurality of female profiles, wherein each female profile is adapted for engagement with a discrete complementary male profile, and wherein the step of providing the tool positioning apparatus into association with the tool comprises providing the tool with a respective discrete complementary male profile corresponding to one of the female profiles.

15. The method of claim 11, further comprising providing a sealing member about the mandrel between the first cone and the second cone.

16. The method of claim 11, wherein at least one of the no-go shoulders of the plurality of grooves prevents upward movement of the tool and permits downward movement of the tool.

17. The method of claim 11, wherein engagement of the discrete complementary profile of the tool with the selected profile of the anchor assembly comprises engaging a selected depth of the grooves in the plurality of grooves, a selected interior shape of the grooves in the plurality of grooves, or combinations thereof, to differentiate the discrete complementary profile from a different complementary profile.

* * * * *